US010557644B1

(12) United States Patent
Steele

(10) Patent No.: US 10,557,644 B1
(45) Date of Patent: Feb. 11, 2020

(54) ADJUSTABLE DRIP PAN

(71) Applicant: Lucas Steele, Slidell, LA (US)

(72) Inventor: Lucas Steele, Slidell, LA (US)

( * ) Notice: Subject to any disclaimer, the term of this patent is extended or adjusted under 35 U.S.C. 154(b) by 309 days.

(21) Appl. No.: 15/474,496

(22) Filed: Mar. 30, 2017

(51) Int. Cl.
*B65D 81/26* (2006.01)
*F24F 13/22* (2006.01)
*F24F 140/30* (2018.01)

(52) U.S. Cl.
CPC ..... *F24F 13/222* (2013.01); *F24F 2140/30* (2018.01)

(58) Field of Classification Search
CPC ..... F25D 21/14; F24F 13/222; F24F 2140/30; F24F 1/36; B65D 21/086; B65D 21/02; B65D 21/0212
USPC ..... 220/4.26, 8, 4.03, 4.21; 206/557
See application file for complete search history.

(56) References Cited

U.S. PATENT DOCUMENTS 3,097,507 A 7/1963 Makuh
4,564,118 A 1/1986 Heyer et al.
5,392,944 A 2/1995 Jennings
5,482,093 A * 1/1996 Tremonti ..... F16N 31/002 137/312
7,900,795 B1 3/2011 Cantolino
7,938,288 B2 5/2011 Oakner et al.
8,376,178 B2 2/2013 Steinberg
9,382,040 B2 7/2016 Huang
9,410,731 B1 8/2016 Rowland
2002/0023293 A1 2/2002 Lewis
2006/0208915 A1 9/2006 Oakner et al.
2016/0209101 A1 7/2016 Hawley, III et al.

FOREIGN PATENT DOCUMENTS

WO WO 2016034223 3/2016

* cited by examiner

*Primary Examiner* — Andrew T Kirsch
*Assistant Examiner* — Elizabeth J Volz
(74) *Attorney, Agent, or Firm* — Intellectual Property Consulting, LLC; Ian C. Barras

(57) ABSTRACT

An adjustable drip pan designed to be installed into tightly-enclosed spaces. Specifically, an adjustable drip pan comprising a bottom pan, said bottom pan comprising a bottom floor, a reservoir, and one or more walls; and a top pan, said top pan comprising a top floor and a lip, wherein said one or more walls form a ridge. Said ridge, said bottom floor, and said reservoir create a water-impermeable basin for collecting water, and said bottom pan and said top pan are slidably adjustable in a plane along an axis, where adjustment of said bottom pan and said top pan is limited, in a first direction of said axis, by touching of said lip and said ridge, and in a second direction of said axis, by touching of a first one of said one or more walls all and said top pan.

12 Claims, 9 Drawing Sheets

ADJUSTABLE DRIP PAN

BACKGROUND OF THE INVENTION

I. Field of the Invention

The present invention relates generally to an adjustable drip pan for installation into air conditioning units.

II. General Background

Centralized air conditioning units contain condenser coils which are used as part of the process of cooling air. One of the problems with such air conditioning units is that the evaporator coils can cause water vapor to condense and drip as liquid water. Most centralized air conditioning units address the problem of dripping condensed water by utilizing some form of a drip pan. Such water catching devices may be connected to drains, which dispose of said condensed water, or float switches, which detect the presence of said condensed water. However, certain types of centralized air conditioning units, in particular, vertically-oriented evaporator units, are installed in homes in such a fashion that replacing or otherwise servicing the drip pan can be very difficult.

In view of the foregoing, there is, in my view, a continuing need for an adjustable drip pan to be installed into tightly-enclosed spaces.

SUMMARY OF THE INVENTION

In accordance with one embodiment, an object of the present invention is to provide an adjustable drip pan comprising a bottom pan comprising a reservoir, a first wall, a second wall, a third wall, a fourth wall, a first ridge, a second ridge, a third ridge, a fourth ridge, and a bottom floor; and a top pan comprising a top floor and a lip; and wherein said first ridge connects to a top of said first wall, said second ridge connects to a top of said second wall, said third ridge connects to a top of said third wall, and said fourth ridge connects to a top of said fourth wall; wherein said first ridge, said second ridge, said third ridge, and said fourth ridge connect to said bottom floor, and said reservoir connects to said third ridge, said fourth ridge, and said bottom floor; wherein said first ridge, said second ridge, said third ridge, said fourth ridge, said bottom floor, and said reservoir create a water-impermeable basin for collecting water; wherein said first ridge, said second ridge, said third ridge, and said fourth ridge form a single member raised above and surrounding said bottom floor; wherein said top floor slopes downward towards said lip, said bottom floor slopes downward toward said reservoir; and wherein said bottom pan and said top pan are slidably adjustable in a plane along an axis, and adjustment of said bottom pan and said top pan is limited, in a first direction of said axis, by touching of said lip and said first ridge, and in a second direction of said axis, by touching of said first wall and said top pan.

In accordance with one embodiment, an object of the present invention is to provide an adjustable drip pan comprising a bottom pan comprising a bottom floor, a reservoir, and one or more walls; a top pan comprising a top floor and a lip; and wherein said one or more walls form a ridge; wherein said ridge connects to said bottom floor and said reservoir and said reservoir connects to said bottom floor wherein said ridge, said bottom floor, and said reservoir create a water-impermeable basin for collecting water; wherein said ridge is raised above and surrounding said bottom floor; wherein said top floor slopes downward towards said lip, said bottom floor slopes downward toward said reservoir; and wherein said bottom pan and said top pan are slidably adjustable in a plane along an axis, and adjustment of said bottom pan and said top pan is limited, in a first direction of said axis, by touching of said lip and said ridge, and in a second direction of said axis, by touching of a first one of said one or more walls all and said top pan.

BRIEF DESCRIPTION OF THE DRAWINGS

The foregoing and other objects, features, and advantages of the invention are apparent from the following detailed description taken in conjunction with the accompanying drawings in which like parts are given like reference numerals and, wherein:

FIG. 4-1 depicts an adjustable drip pan with a float switch connected to an air conditioning unit in a narrow position.

FIG. 4-2 depicts an adjustable drip pan with a float switch connected to an air conditioning unit in a wide position.

Figure 1:
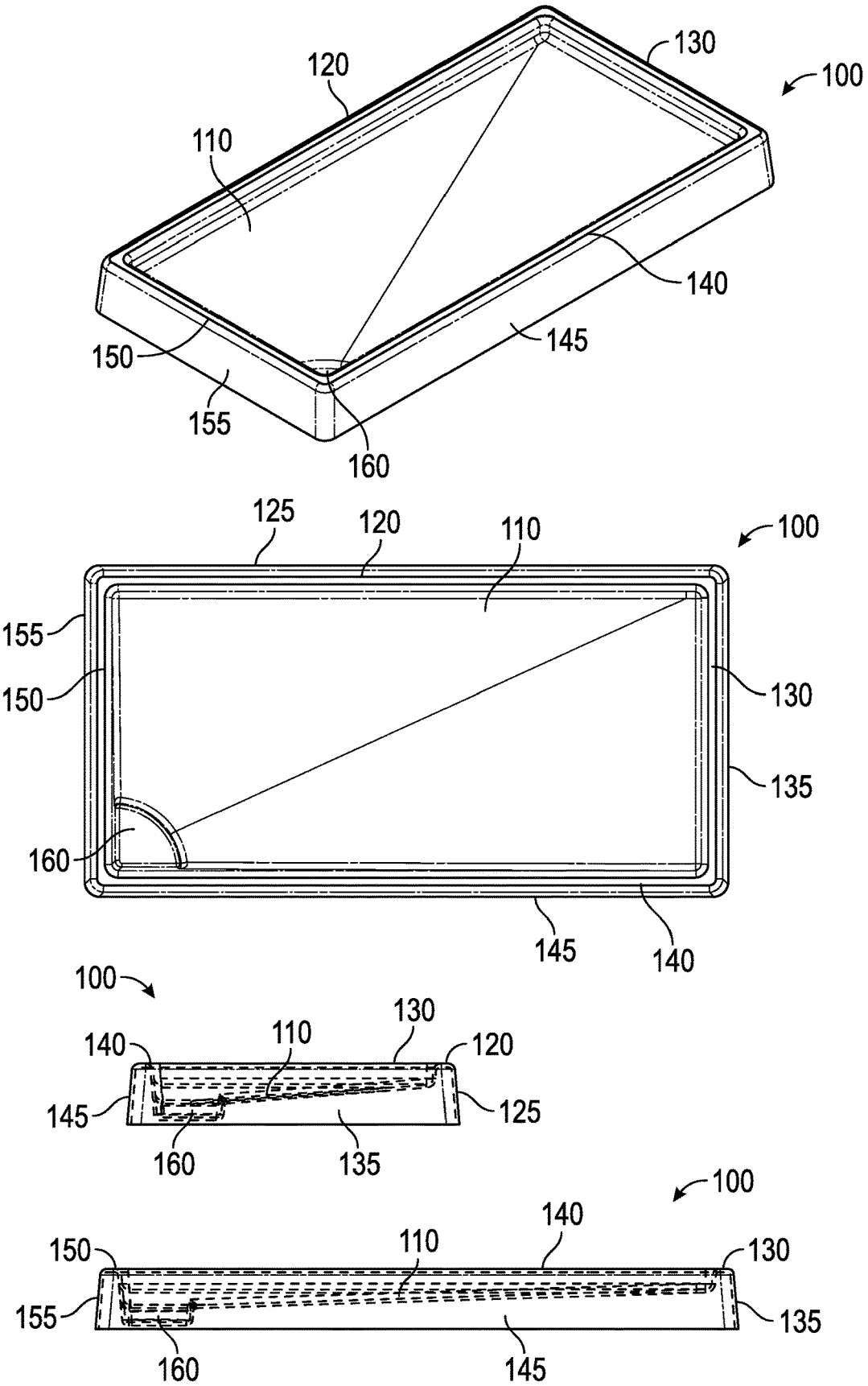
FIG. 1 depicts top, perspective, and two side views of a bottom pan.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

The embodiments of the disclosure will be best understood by reference to the drawings, wherein like parts are designated by like numerals throughout. It will be readily understood that the components, as generally described and illustrated in the Figures herein, could be arranged and designed in a wide variety of different configurations or be entirely separate. Thus, the following more detailed description of the embodiments of the system and method of the disclosure, as represented in the Figures is not intended to limit the scope of the disclosure, as claimed, but is merely representative of possible embodiments of the disclosure.

The Bottom Pan

Figure 1A:
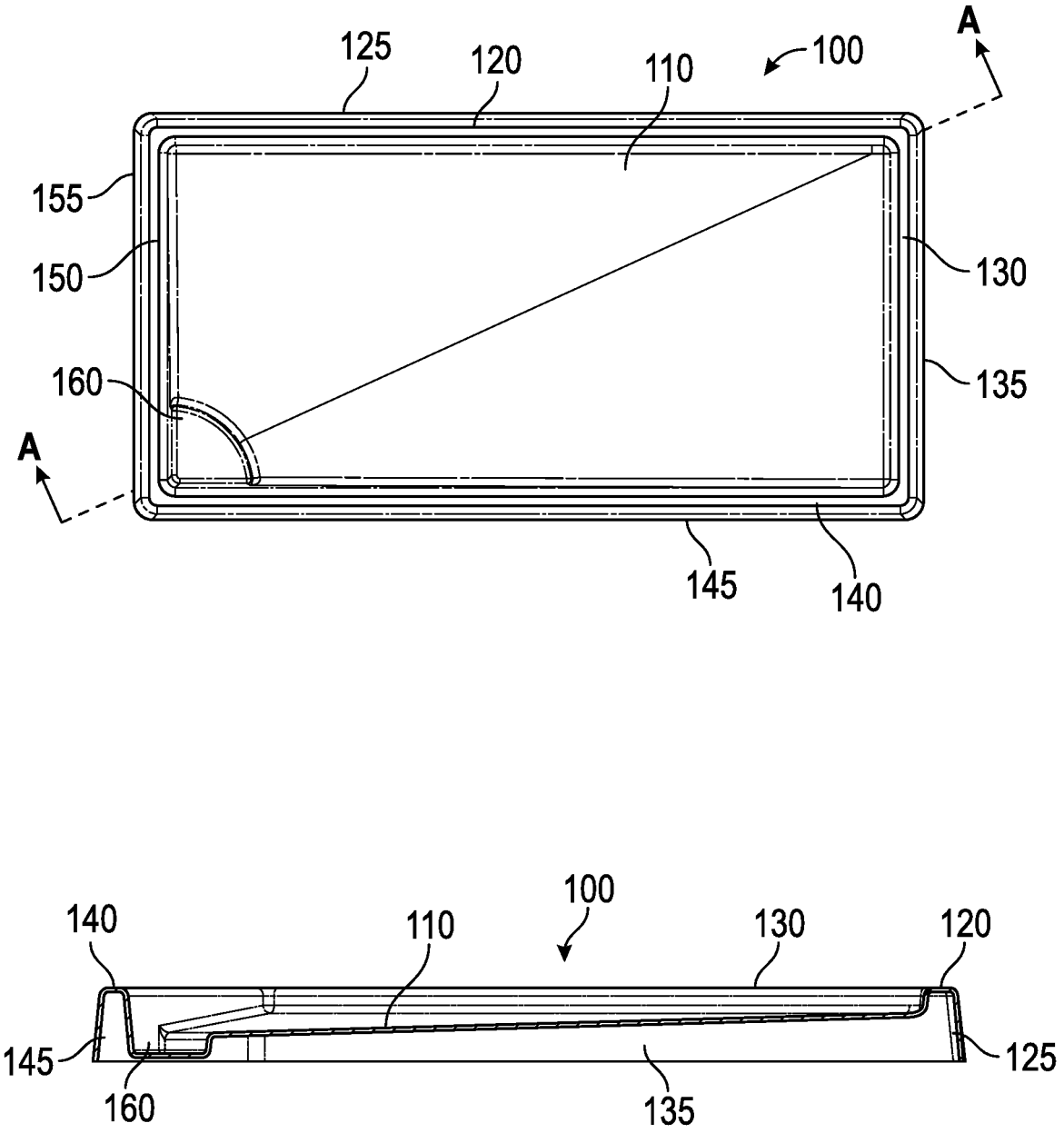
FIG. 1A depicts alternate top and side views of a bottom pan.

FIG. 1 depicts a perspective view, a top view, and two side views of bottom pan 100. FIG. 1A depicts top and side views of bottom pan 100.

Bottom pan 100 comprises bottom floor 110, first bottom ridge 120, first bottom wall 125, second bottom ridge 130, second bottom wall 135, third bottom ridge 140, third bottom wall 145, fourth bottom ridge 150, fourth bottom wall 155, and reservoir 160.

In one embodiment, bottom pan 100 is a single rectangularly shaped piece molded plastic. However, bottom pan 100 may be formed from one or more pieces of any corrosion resistant, water impermeable material. In some embodiments, bottom pan 100 is made from utility grade ABS.

First bottom ridge 120, second bottom ridge 130, third bottom ridge 140, and fourth bottom ridge 150 each connect flush and impermeably to bottom floor 110, such that the highest point of bottom floor 110 is lower than the top of first bottom ridge 120, second bottom ridge 130, third bottom ridge 140, and fourth bottom ridge 150.

First bottom ridge 120 connects, flush and impermeably, to both second bottom ridge 130 and fourth bottom ridge 150. Second bottom ridge 130 also connects, flush and impermeably, to third bottom ridge 140. Third bottom ridge 140 also connects, flush and impermeably, to fourth bottom ridge 150.

First bottom ridge 120 connects to first bottom wall 125. Second bottom ridge 130 connects to second bottom wall 135. Third bottom ridge 140 connects to third bottom wall 145. Fourth bottom ridge 150 connects to fourth bottom wall 155. In an exemplary embodiment, each of said connections to first bottom wall 125, second bottom wall 135, third bottom wall 145, and fourth bottom wall 155 are flush and impermeable.

First bottom wall 125 connects to second bottom wall 135 and fourth bottom wall 155. Second bottom wall 135 also connects to third bottom wall 145. Third bottom wall 145 also connects to fourth bottom wall 155. In an exemplary embodiment, each of said connections of first bottom wall 125, second bottom wall 135, third bottom wall 145, and fourth bottom wall 155 are flush and impermeable.

The bottom portions of first bottom wall 125, second bottom wall 135, third bottom wall 145, and fourth bottom wall 155 define a plane. Thus, when bottom pan 100 is placed on a flat surface, bottom pan 100 lies flat on said flat surface.

Reservoir 160 forms a recessed indentation in bottom pan 100. Reservoir 160 is connected, flush and impermeably, to third bottom ridge 140, fourth bottom ridge 150, and bottom floor 110.

First bottom ridge 120, second bottom ridge 130, third bottom ridge 140, and fourth bottom ridge 150 extend upward from bottom floor 110. Thus, first bottom ridge 120, second bottom ridge 130, third bottom ridge 140, fourth bottom ridge 150, and bottom floor 110 create a basin to catch water that drips onto bottom floor 110.

Bottom floor 110 is sloped, downwardly toward reservoir 160. The slope of bottom floor 110 allows water that drips onto bottom floor 110 to flow into reservoir 160. In an exemplary embodiment, the highest point of bottom floor 110 is where bottom floor 110 meets the corner formed by first bottom ridge 120 and second bottom ridge 130. In one embodiment, water that flows into reservoir 160 does not flow out. However, other embodiments of reservoir 160 may include drains.

In one embodiment, components of bottom pan 100 have the following dimensions. First bottom ridge 120 and third bottom ridge 140 are 23.65" in length. Second bottom ridge 130 and fourth bottom ridge 150 are 12.04" in length. First bottom wall 125 and third bottom wall 145 are 24.00" in length. Second bottom wall 135 and fourth bottom wall 155 are 12.39" in length. First bottom ridge 120, second bottom ridge 130, third bottom ridge 140, and fourth bottom ridge 150 rise 2.25" above the bottommost portion of bottom pan 100. Bottom floor 110, at its highest point, rises 1.48" above the bottommost portion of bottom pan 100. Bottom floor 110 rises 0.88" above the bottommost portion of bottom pan 100 at reservoir 160. Bottom floor 110 has a slope of 1.61 degrees. Third bottom ridge 140 rises 2.00" above reservoir 160. Reservoir 160 is approximately a quarter-circle having a radius of 1.93" in length. First bottom ridge 120, second bottom ridge 130, third bottom ridge 140, and fourth bottom ridge 150 are 0.87" wide at their respective topmost points.

The Top Pan

Figure 2:
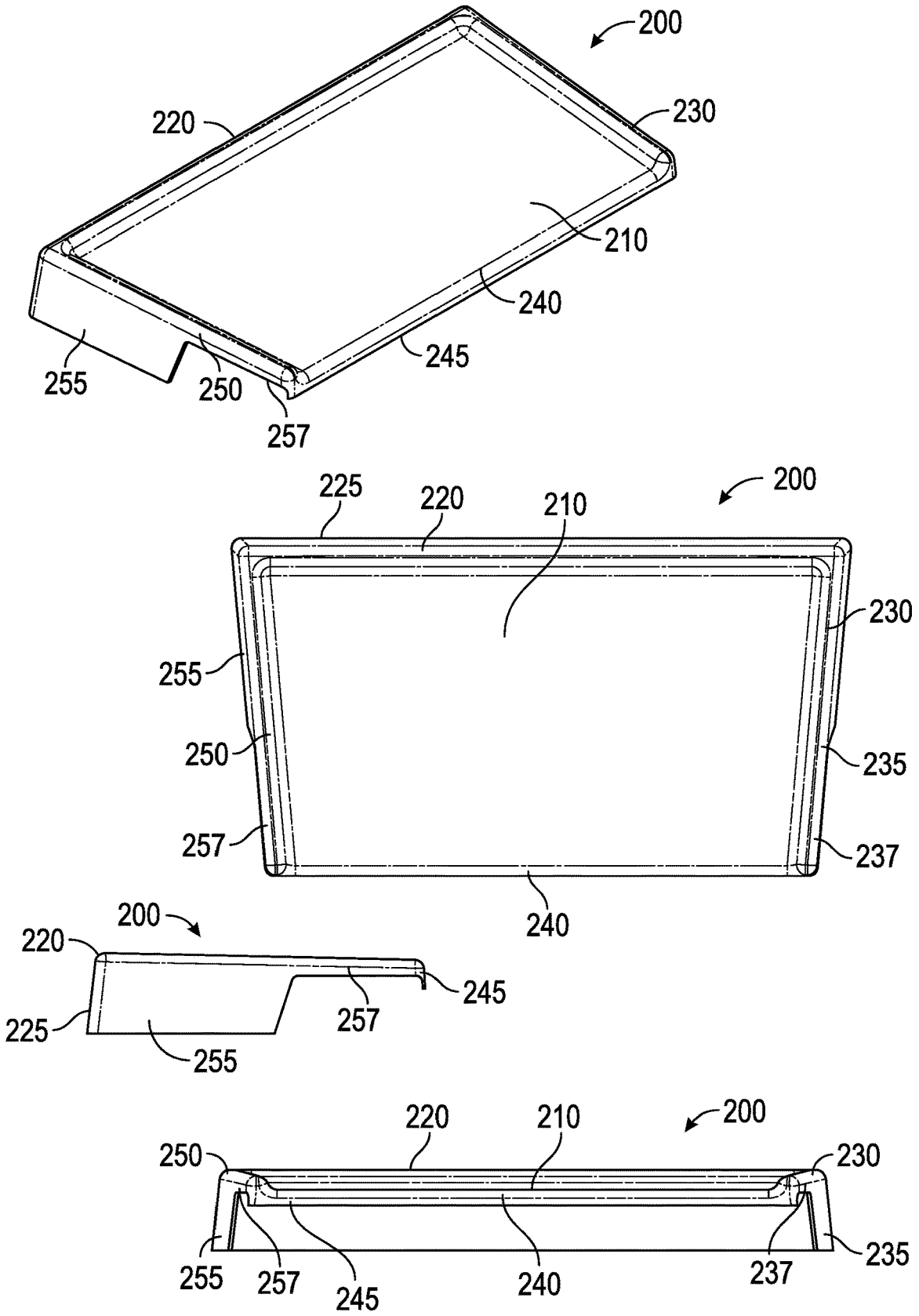
FIG. 2 depicts top, perspective, and two side views of a top pan.
Figure 2A:
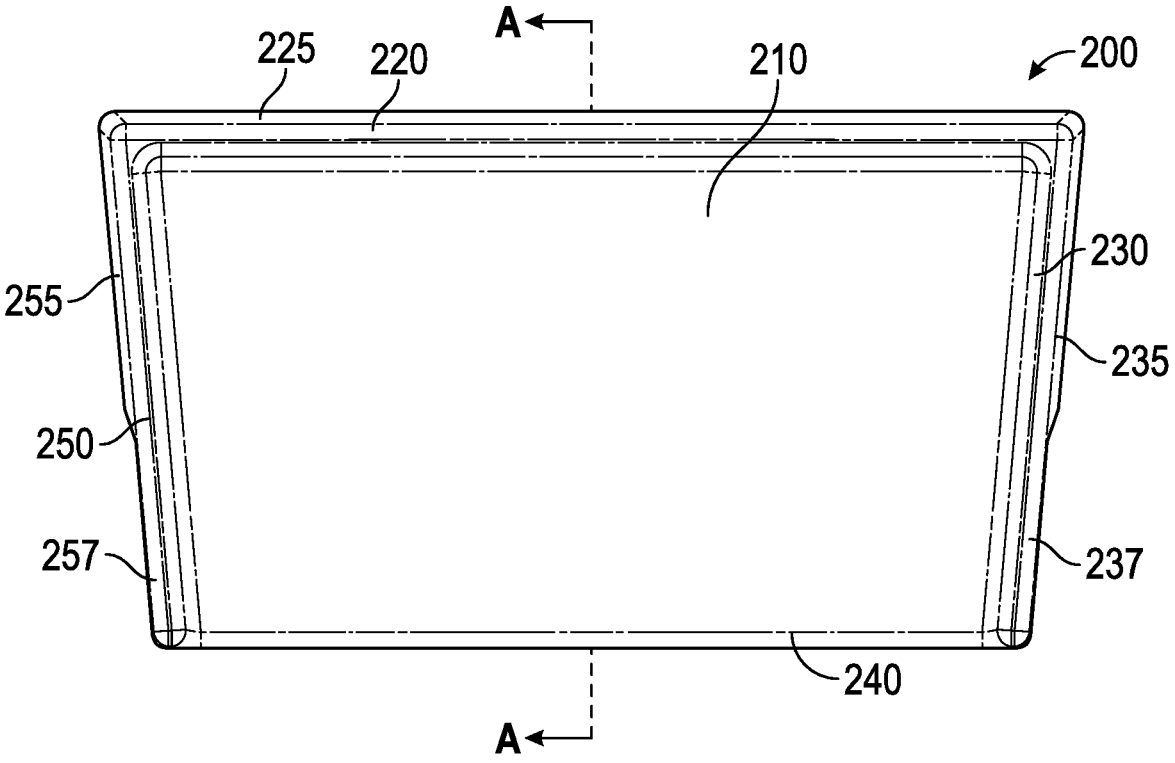
FIG. 2A depicts alternate top and side views of a top pan.
Figure 2A:
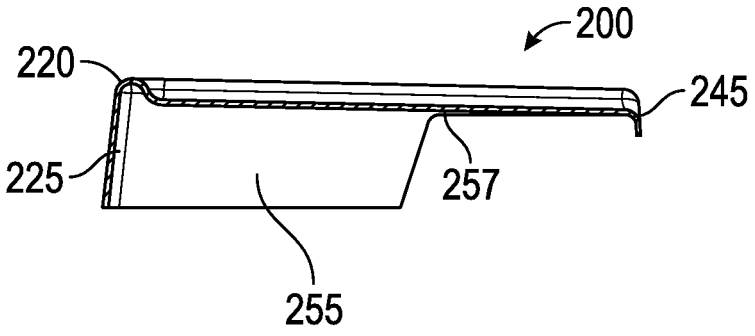

FIG. 2 depicts perspective, top, and two side views of top pan 200. FIG. 2A depicts alternate top and side views of top pan 200.

Top pan 200 comprises top floor 210, first top ridge 220, first top wall 225, second top ridge 230, second top wall 235, third top ridge 240, lip 245, fourth top ridge 250, and fourth top wall 255.

In an embodiment, top pan 200 is a single rectangularly shaped piece molded plastic. However, top pan 200 may be formed from one or more pieces of any corrosion resistant, water impermeable material. In some embodiments, top pan 200 is made from utility grade ABS.

First top ridge 220, second top ridge 230, third top ridge 240, and fourth top ridge 250 each connect flush and impermeably to top floor 210, such that the highest point of top floor 210 is lower than the top of first top ridge 220.

First top ridge 220 connects, flush and impermeably, to both second top ridge 230 and fourth top ridge 250. Second top ridge 230 also connects, flush and impermeably, to third top ridge 240. Third top ridge 240 also connects, flush and impermeably, to fourth top ridge 250.

First top ridge 220 connects to first top wall 225. Second top ridge 230 connects to second top wall 235. Third top ridge 240 connects to lip 245. Fourth top ridge 250 connects to fourth top wall 255. In an exemplary embodiment, each of said connections to first top wall 225, second top wall 235, lip 245, and fourth top wall 255 are flush and impermeable.

First top wall 225 connects to second top wall 235 and fourth top wall 255. Second top wall 235 also connects to lip 245. Lip 245 also connects to fourth top wall 255. In an exemplary embodiment, each of said connections of first top wall 225, second top wall 235, lip 245, and fourth top wall 255 are flush and impermeable.

The bottommost portions of first top wall 225, second top wall 235, and fourth top wall 255 define a plane. Thus, when top pan 200 is placed on a flat surface, top pan 200 lies flat on said flat surface.

Second top wall 235 further comprises first raised member 237. First raised member 237 is a portion of second top wall 235 that extends downward from second top ridge 230 but does not extend downward all the way to the bottommost portion of second top wall 235.

Fourth top wall 255 further comprises second raised member 257. Second raised member 257 is a portion of fourth top wall 255 that extends downward from fourth top ridge 250 but does not extend downward all the way to the bottommost portion of fourth top wall 255.

In one embodiment, top pan 200 is symmetrical about axis A shown in FIG. 2A. Thus, second top wall 235, and first raised member 237 are configured to match fourth top wall 255 and second raised member 257.

First top ridge 220, second top ridge 230, and fourth top ridge 250 extend upward from top floor 210. Third top ridge 240 does not extend upward from top floor 210. Top floor 210 is sloped, downwardly toward third top ridge 240. Thus, first top ridge 220, second top ridge 230, fourth top ridge 250, and top floor 210 create a channel for water that drips onto top floor 210 to flow along top floor 210, and over third top ridge 240 and lip 245.

In one embodiment, components of top pan 200 have the following dimensions. First wall 225 has a length of 24.00" in length. The distance between the outermost portion of first top wall 225 and the outermost portion of lip 245 is 13.08" in length. Third top ridge is 21.26" in length. Lip 245 is 20.75" in length. First top ridge 220 rises 3.14" above the bottommost portion of top pan 200. The bottommost portion of first raised member 237 and second raised member 257 is 2.25" above the bottommost portion of top pan 200. The bottommost portion of lip 245 rises 1.75" above the bottommost portion of top pan 200. The topmost portion of first top ridge 220 and the topmost portion of third top ridge 240 is 0.25". The topmost portion of third top ridge 240 is 0.63" higher than the bottommost portion of lip 245. Top floor 210 has a slope of 1.21 degrees. Second top wall 235 and fourth top wall 255 extend for 7.23" before extending upward at first raised member 237 and second raised member 257. Thus, the portions of second top wall 235 and fourth top wall 255 which extend to the bottommost portion of top pan 200 are 7.23" in length. The remainder of second top wall 235 and fourth top wall 255 (first raised member 237 and second raised member 257, respectively) rises above the bottommost portion of top pan 200. First top wall 225 rises upwards at an 83.79 degree angle, pointing towards top floor 210.

Top Pan and Bottom Pan Combined

Figure 3:
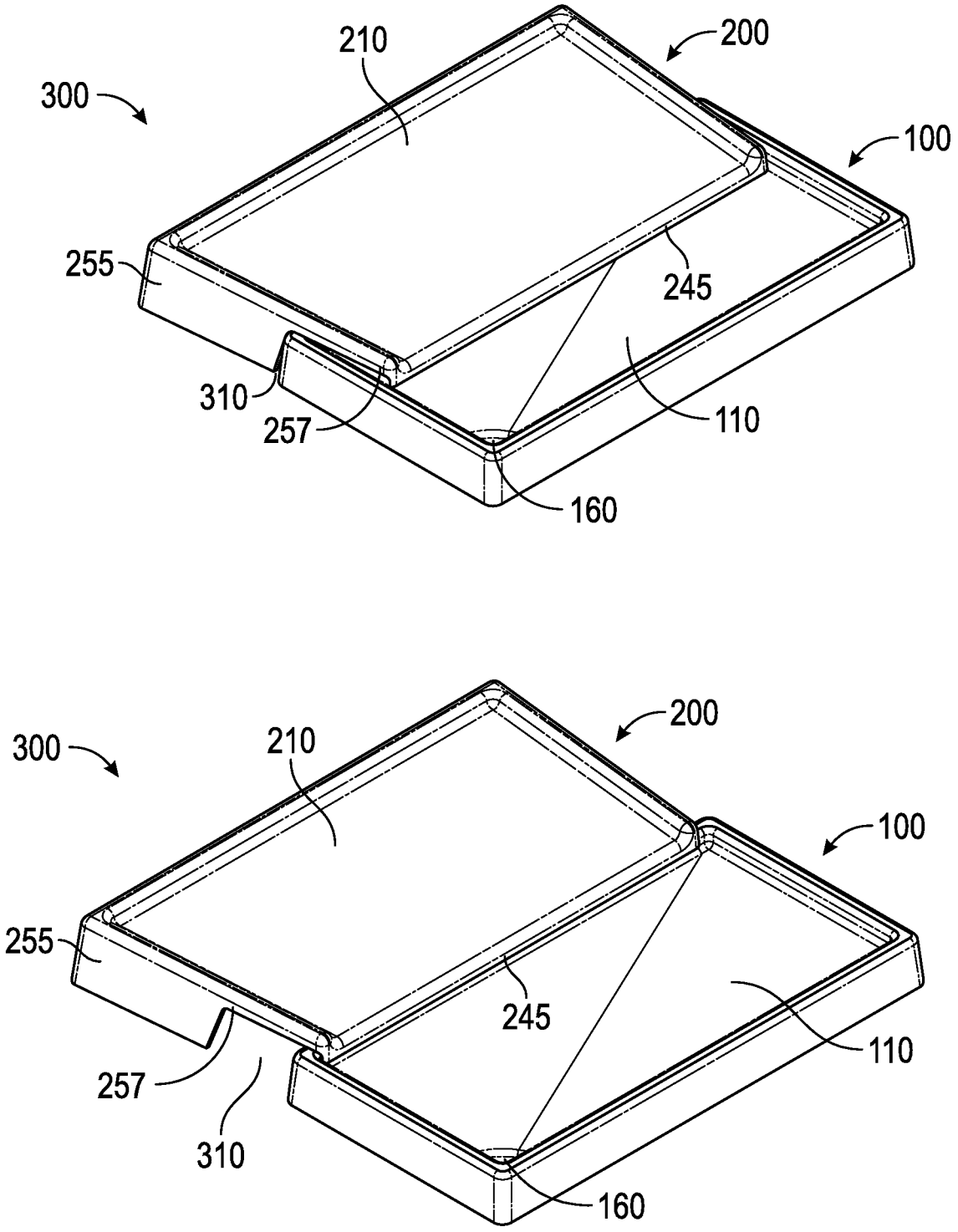
FIG. 3 depicts a perspective view of a top pan and a bottom pan placed together in a wide position and a perspective view of a top pan and a bottom pan placed together in a narrow position.
Figure 3A:
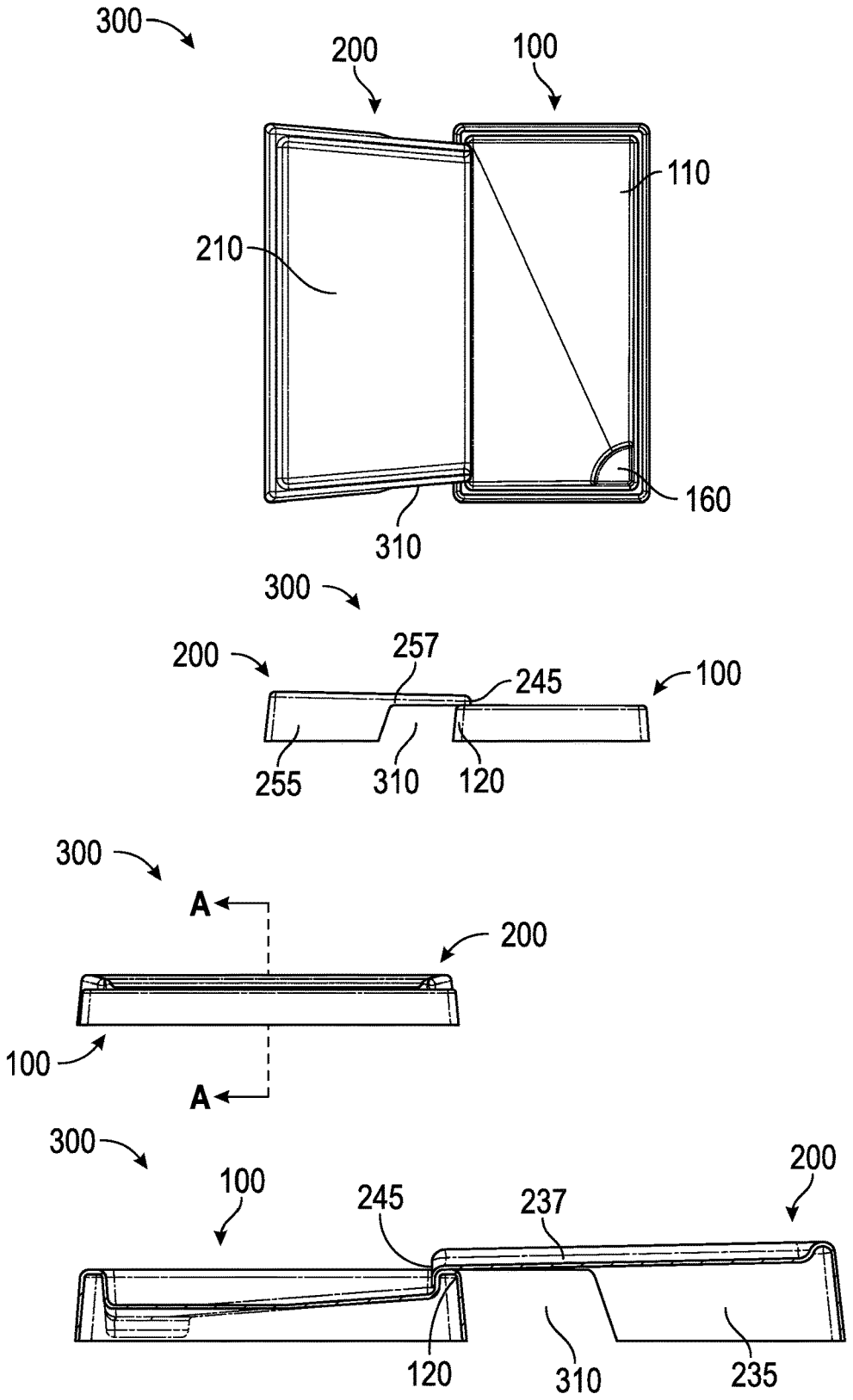
FIG. 3A depicts a top view and three side views of a top pan and a bottom pan placed together in a wide position.
Figure 3B:
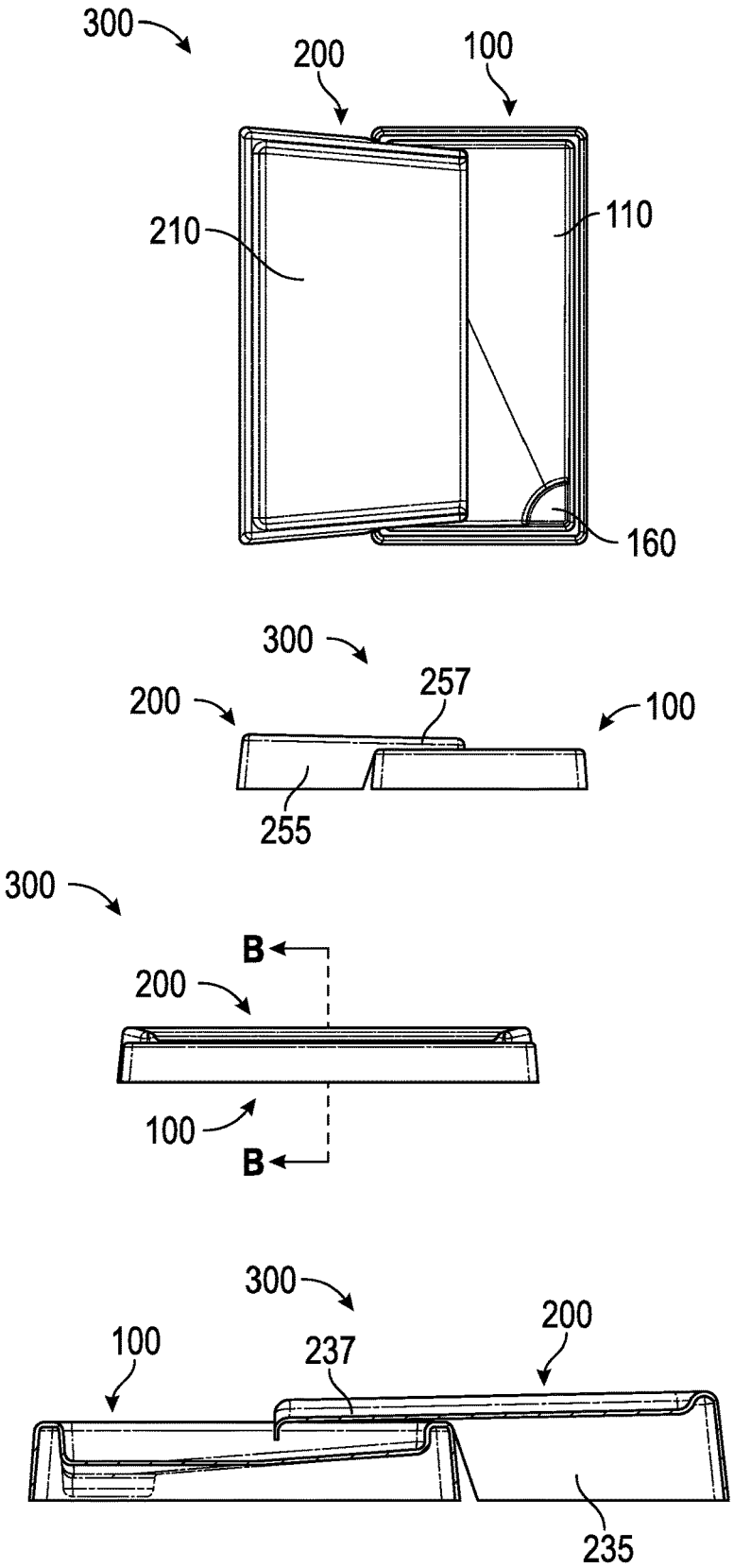
FIG. 3B depicts a top view and three side views of a top pan and a bottom pan placed together in a narrow position.

FIG. 3 depicts perspective views of drip pan system 300 in narrow and wide positions. FIG. 3A depicts top and side views of drip pan system 300 in a wide position. FIG. 3B depicts top and side views of drip pan system 300 in a narrow position.

Drip pan system 300 comprises bottom pan 100 and top pan 200. As combined, drip pan system 300 also comprises gap 310. The size of gap 310 is adjustable based on the relative positions of bottom pan 100 and top pan 200. In a narrow position, gap 310 is smaller. In a wide position, gap 310 is larger. In an exemplary embodiment, gap 310 may be adjustably configured to be anywhere between 0.0" and approximately 5.00".

In an exemplary embodiment of drip pan system 300, bottom pan 100 and top pan 200 are not physically connected. However, other embodiments of drip pan system may comprise connections between bottom pan 100 and top pan 200. For example, bottom pan 100 and top pan 200 may be connected by fastening means such as screws, snaps, or magnetic fasteners. Alternatively, bottom pan 100 and top pan 200 may be made of a single piece of material, with flexible portions thereof connecting and allowing adjustment between top pan 200 and bottom pan 100.

In an exemplary embodiment, first top wall 225, second top wall 235, and fourth top wall 255 are taller than first bottom wall 125, second bottom wall 135, third bottom wall 145, and fourth bottom wall 155. Thus, top floor 210 is higher than bottom floor 110.

In an exemplary embodiment, first raised member 237 and second raised member 257 extend downward only to the height of first bottom ridge 120, thus leaving space for gap 310 and for bottom pan 100 to slide underneath first raised member 237 and second raised member 257.

In an exemplary embodiment of drip pan system 300, top floor 210 extends over first bottom ridge 120. And, as may be understood from the figures, in particular FIG. 3A, after top pan 200 is placed over bottom pan 100, physical contact between lip 245 and first bottom ridge 120 prevents excess displacement between bottom pan 100 and top pan 200, keeping top floor 210 over first bottom ridge 120. Thus, physical contact between lip 245 and first bottom ridge 120 acts as a safety to maintain a reliable path for water that falls onto top floor 210 to flow along the slope of top floor 210, over lip 245 to reach bottom floor 110 and eventually reservoir 160.

Figure 4:
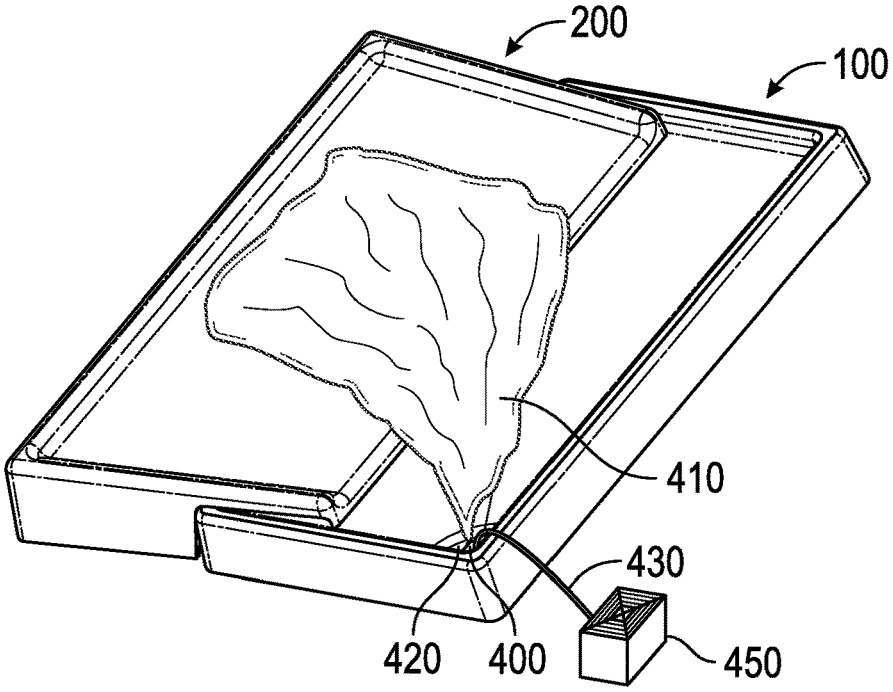
Figure 1:
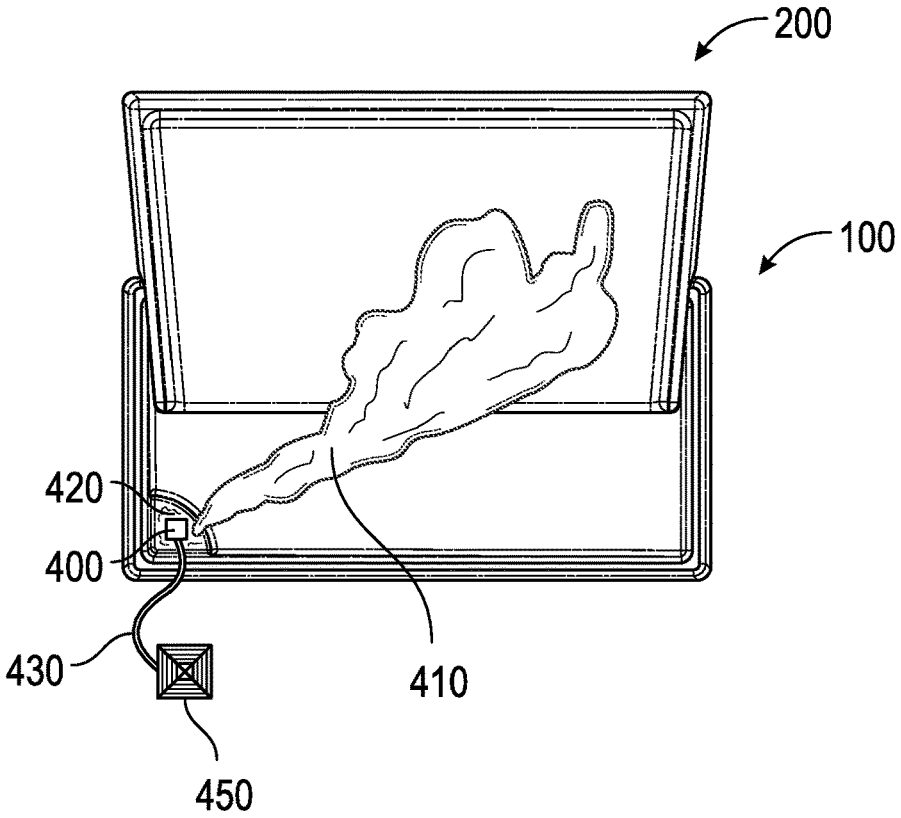
Figure 4:
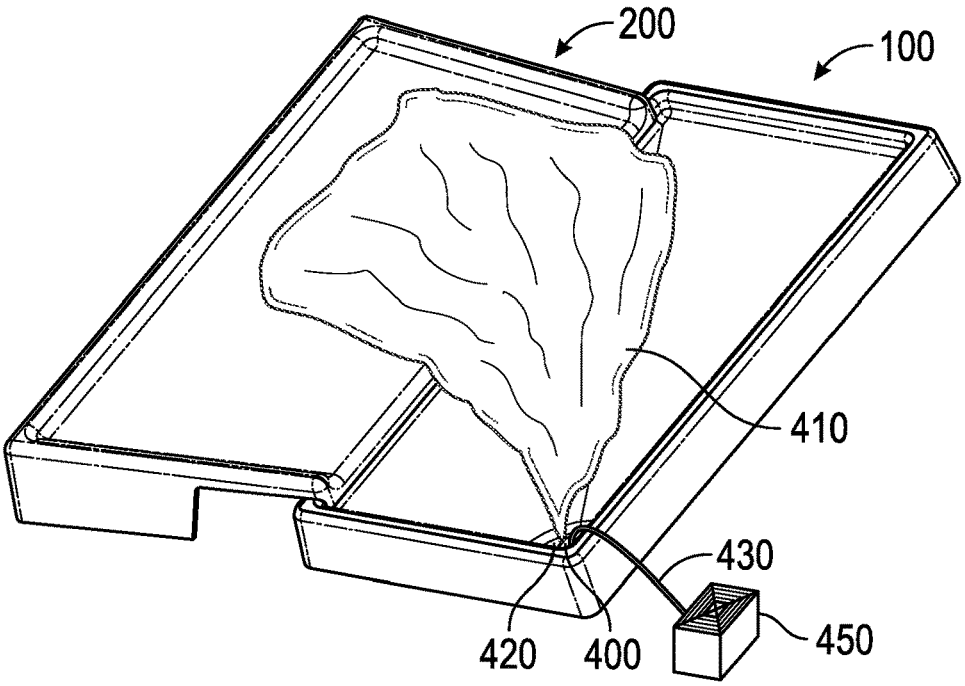
Figure 2:
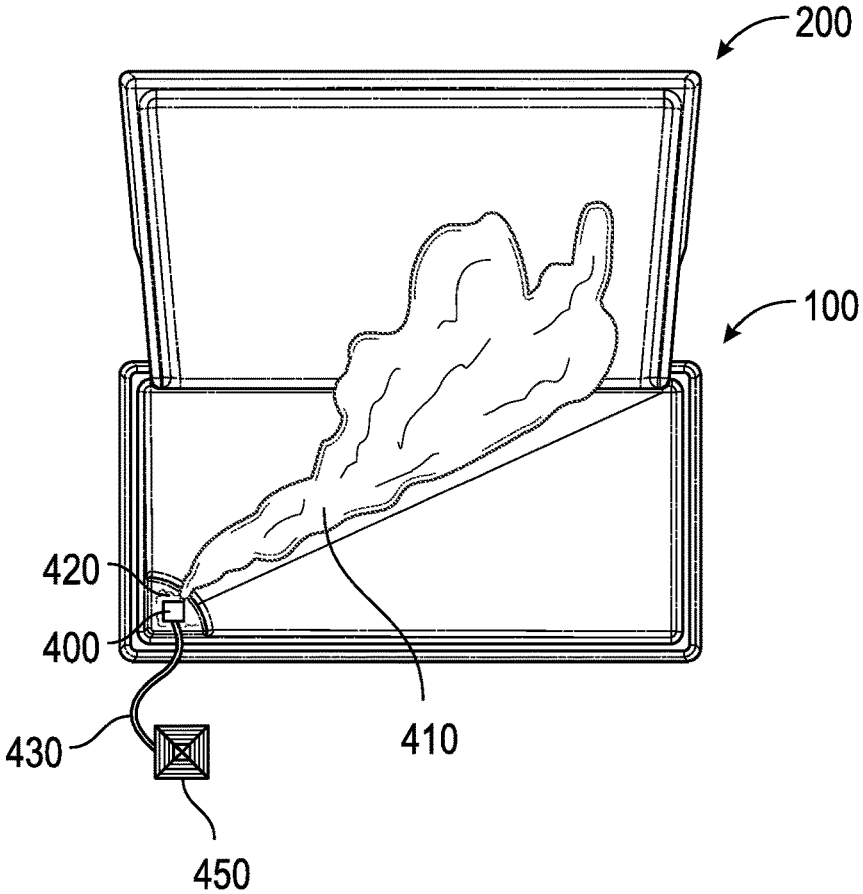

FIG. 4-1 depicts drip pan system 300 with float switch 400 installed into air conditioning system 450 in a narrow position.

FIG. 4-2 depicts drip pan system 300 with float switch 400 installed into air conditioning system 450 in a wide position.

Float switch 400 is any standard float switch which may be used to detect a level of liquid. As depicted in FIGS. 4-1 and 4-2, float switch 400 is installed in reservoir 160 of bottom pan 100. Thus, when one or more water droplets 410 falls onto top floor 210, one or more water droplet 410 flow downward and fall onto bottom floor 110, then into trapped water 420 in reservoir 160. When enough of one or more water droplets 410 flow into trapped water 420 in reservoir 160, float switch 400 detects the presence of trapped water 420 and triggers air conditioning system 450 to cease operating. Float switch 400 is connected to air conditioning system 450 by wire 430 (or via wireless connection or other similar connection) and triggers air conditioning system 450 by sending an electric current through wire 430. When evaporation lowers the level of trapped water 420 in reservoir 160 beyond the point of detection of float switch 400, float switch 400 no longer detects the presence of trapped water 420 and thus no longer triggers air conditioning system 450 to cease operating.

In other embodiments (not shown), bottom pan 100, top pan 200, and drip pan system 300 may take another configuration than the one shown in the figures. Other suitable sizes, shapes, and materials may be used.

What is claimed is:

1. An adjustable drip pan comprising:

a bottom pan comprising a reservoir, a first wall, a second wall, a third wall, a fourth wall, a first ridge, a second ridge, a third ridge, a fourth ridge, and a bottom floor; and a top pan comprising a top floor and a lip; and wherein said first ridge connects to a top of said first wall, said second ridge connects to a top of said second wall, said third ridge connects to a top of said third wall, and said fourth ridge connects to a top of said fourth wall;

wherein said first ridge, said second ridge, said third ridge, and said fourth ridge connect to said bottom floor, and said reservoir connects to said third ridge, said fourth ridge, and said bottom floor;

wherein said first ridge, said second ridge, said third ridge, said fourth ridge, said bottom floor, and said reservoir create a water-impermeable basin for collecting water;

wherein said first ridge, said second ridge, said third ridge, and said fourth ridge form a single member raised above and surrounding said bottom floor;

wherein said top floor slopes downward towards said lip, said bottom floor slopes downward toward said reservoir; and wherein said bottom pan and said top pan are slidably adjustable in a plane along an axis, and adjustment of said bottom pan and said top pan is limited, in a first direction of said axis, by touching of said lip and said first ridge, and in a second direction of said axis, by touching of said first wall and said top pan.

2. The adjustable drip pan of claim 1, wherein said top pan fits over a portion of said bottom pan.

3. The adjustable drip pan of claim 2, wherein and said top pan is supported by contact between said top pan and said first wall of said bottom pan when said bottom pan and said top pan are limited in said first direction of said axis, said lip sits flush over said first wall of said bottom pan.

4. The adjustable drip pan of claim 3, wherein when a drop of water falls onto said top floor, said drop of water flows along said top floor and falls onto said bottom floor, then flows along said bottom floor into said reservoir.

5. The adjustable drip pan of claim 4, further comprising a float switch, wherein said float switch is seated in an interior of said reservoir.

6. The adjustable drip pan of claim 5, wherein said top pan further comprises three outwardly flared walls and said first wall, said second wall, said third wall, and said fourth wall are each outwardly flared.

7. The adjustable drip pan of claim 6, wherein said top pan is formed from a first single piece of plastic and said bottom pan is formed from a second single piece of plastic.

8. The adjustable drip pan of claim 7, wherein said top floor is flat and is sloped downward at 1.21 degrees, and said bottom floor is flat and is sloped downward at 1.61 degrees.

9. An adjustable drip pan comprising:

a bottom pan comprising a bottom floor, a reservoir, and one or more walls;

a top pan comprising a top floor and a lip, wherein said top pan fits over a portion of said bottom pan; and a float switch, wherein said float switch is seated in an interior of said reservoir;

wherein said one or more walls form a ridge;

wherein said ridge connects to said bottom floor and said reservoir and said reservoir connects to said bottom floor wherein said ridge, said bottom floor, and said reservoir create a water impermeable basin for collecting water;

wherein said ridge is raised above and surrounding said bottom floor;

wherein said top floor slopes downward towards said lip, said bottom floor slopes downward toward said reservoir;

wherein said bottom pan and said top pan are slidably adjustable in a plane along an axis, and adjustment of said bottom pan and said top pan is limited, in a first direction of said axis, by touching of said lip and said ridge, and in a second direction of said axis, by touching of a first one of said one or more walls all and said top pan;

wherein and said top pan is supported by contact between said top pan and said first one of said one or more walls of said bottom pan when said bottom pan and said top pan are limited in said first direction of said axis, said lip sits flush over said first one of said one or more walls of said bottom pan; and wherein when a drop of water falls onto said top floor, said drop of water flows along said top floor and falls onto said bottom floor, then flows along said bottom floor into said reservoir.

10. The adjustable drip pan of claim 9, wherein said top pan further comprises one or more outwardly flared walls and each of said one or more walls of said bottom pan are outwardly flared.

11. The adjustable drip pan of claim 10, wherein said top pan is formed from a first single piece of plastic and said bottom pan is formed from a second single piece of plastic.

12. The adjustable drip pan of claim 11, wherein said top floor is flat and is sloped downward at 1.21 degrees, and said bottom floor is flat and is sloped downward at 1.61 degrees.

* * * * *